US007581844B1

(12) United States Patent
Yang

(10) Patent No.: US 7,581,844 B1
(45) Date of Patent: Sep. 1, 2009

(54) SWITCH COVER PLATE WITH LIGHTING MECHANISM

(76) Inventor: Hsiu-Ling Yang, No. 2, Lane 6 Lin sen Road, Tauyuan City (TW)

( * ) Notice: Subject to any disclaimer, the term of this patent is extended or adjusted under 35 U.S.C. 154(b) by 0 days.

(21) Appl. No.: 12/054,177

(22) Filed: Mar. 24, 2008

(51) Int. Cl.
*F21V 33/00* (2006.01)

(52) U.S. Cl. ..... 362/95; 362/191

(58) Field of Classification Search ..... 362/95, 362/183–185, 190, 191, 200, 202, 205, 208; 200/310, 313, 317
See application file for complete search history.

(56) References Cited

U.S. PATENT DOCUMENTS 4,514,789 A * 4/1985 Jester ..... 362/95
4,611,264 A * 9/1986 Bradley ..... 362/95
4,750,095 A * 6/1988 Huang ..... 362/190
4,967,323 A * 10/1990 Johnson et al. ..... 362/103
6,007,216 A * 12/1999 Donnelly ..... 362/191
6,010,228 A * 1/2000 Blackman et al. ..... 362/95
6,864,798 B2 * 3/2005 Janik ..... 340/693.11
6,883,927 B2 * 4/2005 Cunningham et al. ..... 362/95

FOREIGN PATENT DOCUMENTS

JP 08087908 A * 4/1996

* cited by examiner

*Primary Examiner*—Hargobind S Sawhney
(74) *Attorney, Agent, or Firm*—WPAT, P.C.; Anthony King

(57) ABSTRACT

A switch cover plate with lighting mechanism includes a cover plate having a receiving section arranged on at least one edge thereof, and a lighting mechanism removably assembled to the cover plate. The lighting mechanism includes an enclosure, a retaining section located on at least one side of the enclosure for detachably connecting to the receiving section, a control unit provided in the enclosure, and at least one light-emitting unit provided on the enclosure and electrically connected to the control unit. The lighting mechanism can be easily assembled to and removed from the cover plate for use as night lighting, emergency lighting, and a mobile lighting device.

4 Claims, 5 Drawing Sheets

SWITCH COVER PLATE WITH LIGHTING MECHANISM

FIELD OF THE INVENTION

The present invention relates to a switch cover plate with lighting mechanism, and more particularly to a lighting mechanism that can be easily assembled to and removed from a cover plate for use as night lighting, emergency lighting, and a mobile lighting device.

BACKGROUND OF THE INVENTION

Generally, an indoor light switch is equipped with a light emitter, which forms a light spot for a user to easily locate and turn on the light switch in a dark environment. However, the light emitter only emits weak light sufficient for a user to locate the light switch, and therefore can hardly serve as a lighting fixture. An additional mini lamp is usually required for night lighting.

On the other hand, an emergency light is normally provided in a general building for lighting in an unexpected power failure. Light emitters in the emergency light are off when the public power supply is normal, and a battery of the emergency light is charged. In the event of a power failure, an internal switch of the emergency light switches on the battery for the same to supply power to the light emitters, so that the emergency light keeps lighting. However, the emergency light is usually fixedly mounted to a relatively high place in the building. Therefore, the emergency light could not be inconveniently checked or tested. Moreover, once the emergency light is mounted, it is unmovable. This limits the emergency light to illuminate only a small area from a fixed angle. Furthermore, the existing emergency light has a considerable large volume and it is often necessary to drill holes on a wall for installing the emergency light. Such procedure is quite troublesome and complicated. Therefore, people rarely install such emergency light in general family houses. Instead, a flashlight is often used as a domestic emergency lighting device in a power failure. However, while the flashlight has a small volume and is easily portable, it is frequently positioned by a user at different places and can not be quickly located for use in a sudden power failure.

SUMMARY OF THE INVENTION

It is therefore a primary object of the present invention to provide a switch cover plate with lighting mechanism, which includes a lighting mechanism that can be easily assembled to and removed from the switch cover plate for use as night lighting, emergency lighting, and a mobile lighting device.

According to the above object, the switch cover plate with lighting mechanism of the present invention includes a cover plate having a receiving section arranged on at least one edge of the cover plate and a lighting mechanism removably assembled to the cover plate at the receiving section. The lighting mechanism includes an enclosure, a retaining section provided on at least one side of the enclosure for detachably connecting to the receiving section of the cover plate, a control unit provided in the enclosure, and at least one light-emitting unit provided on the enclosure at predetermined positions and electrically connected to the control unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
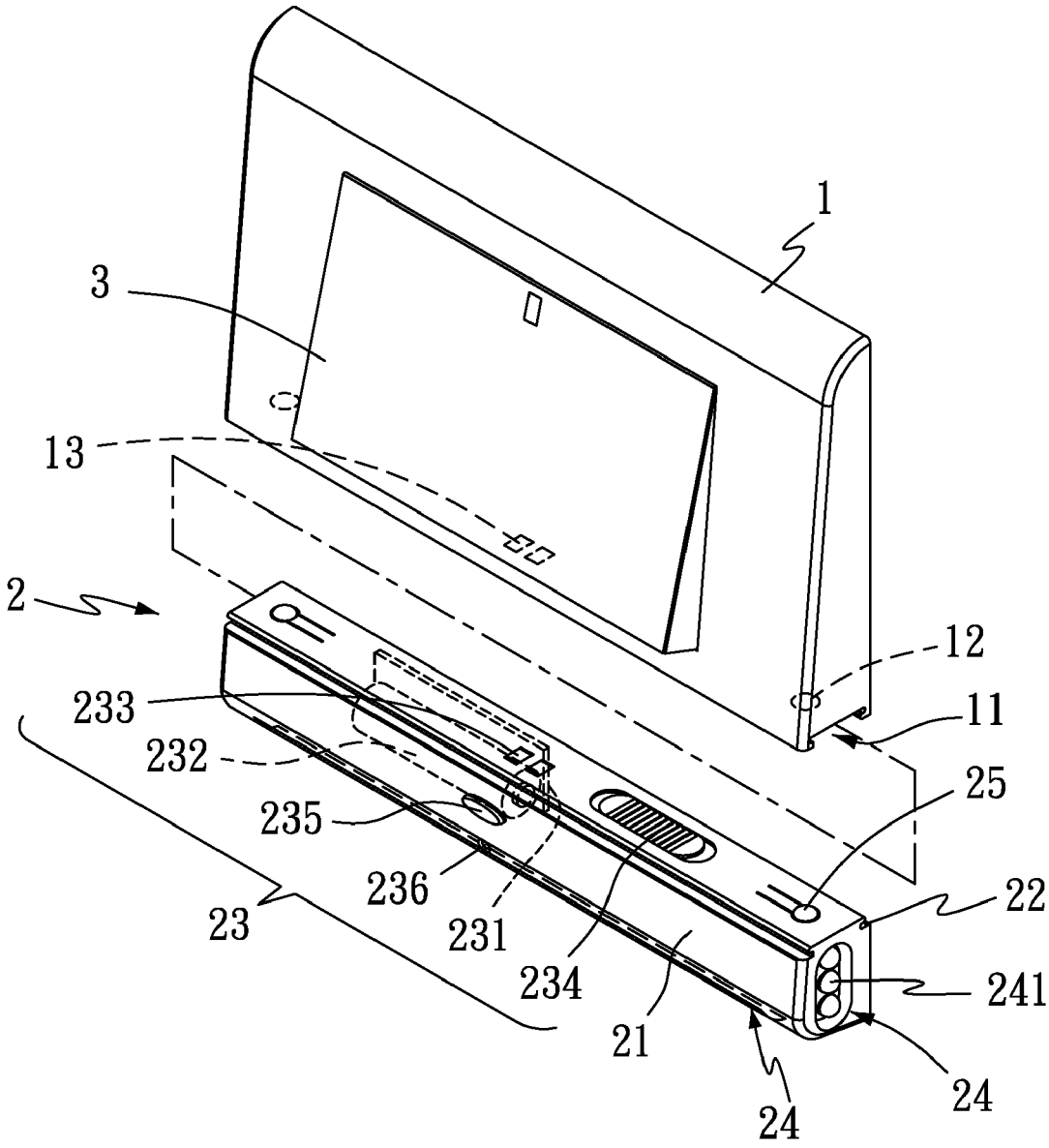
FIG. 1 is an exploded perspective view of the present invention.
Figure 2:
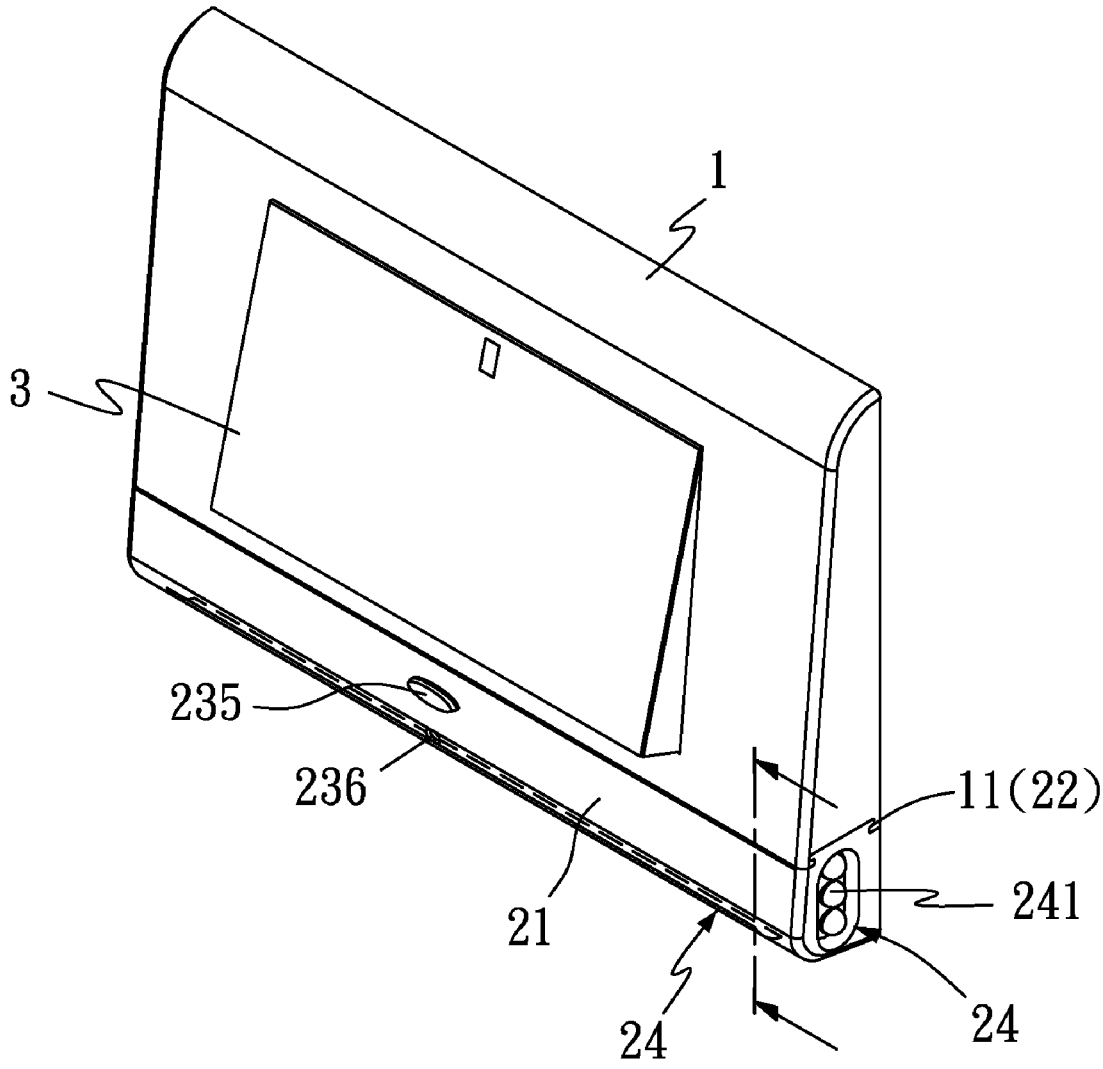
FIG. 2 is an assembled perspective view of the present invention.

Please refer to FIGS. 1 and 2 that are exploded and assembled perspective views, respectively, of a switch cover plate with lighting mechanism according to the present invention. As shown, the switch cover plate of the present invention includes a cover plate 1 and a lighting mechanism 2. The lighting mechanism 2 can be easily assembled to and disassembled from the cover plate 1 for use as night lighting, emergency lighting, and a mobile lighting device.

The cover plate 1 is arranged on at least one edge with a receiving section 11, which may be an insertion channel. Multiple locating holes 12 are formed on a wall of the receiving section 11. In addition, a conductive section 13 is provided on a wall of the receiving section 11 for electrically connecting to an external power supply.

The lighting mechanism 2 is removably assembled to the cover plate 1, and includes an enclosure 21, a retaining section 22 formed on at least one side of the enclosure 21 for detachably connecting to the receiving section 11, a control unit 23 arranged in the enclosure 21, and at least one light-emitting unit 24 provided on the enclosure 21. In a preferred embodiment, the retaining section 22 is a guide slide slidably engaged with the receiving section 11. In addition, multiple locating leaf springs 25 are arranged on the retaining section 22 for interfering with the locating holes 12 of the receiving section 11. The control unit 23 includes at least one control circuit 231 and a power supply 232 disposed in the enclosure 21 and electrically connected to the control circuit 231. The control unit 23 further includes a power input 233 arranged on the retaining section 22 for electrically contacting with the conductive section 13, an ON/OFF switch 234 positioned on the enclosure 21, a test switch 235, and a light-detecting element 236. The light-emitting unit 24 is composed of multiple light emitters 241 electrically connected to the control circuit 231. In the illustrated preferred embodiment, the light emitters 241 are separately arranged at an end and along a lateral side of the enclosure 21.

Figure 3:
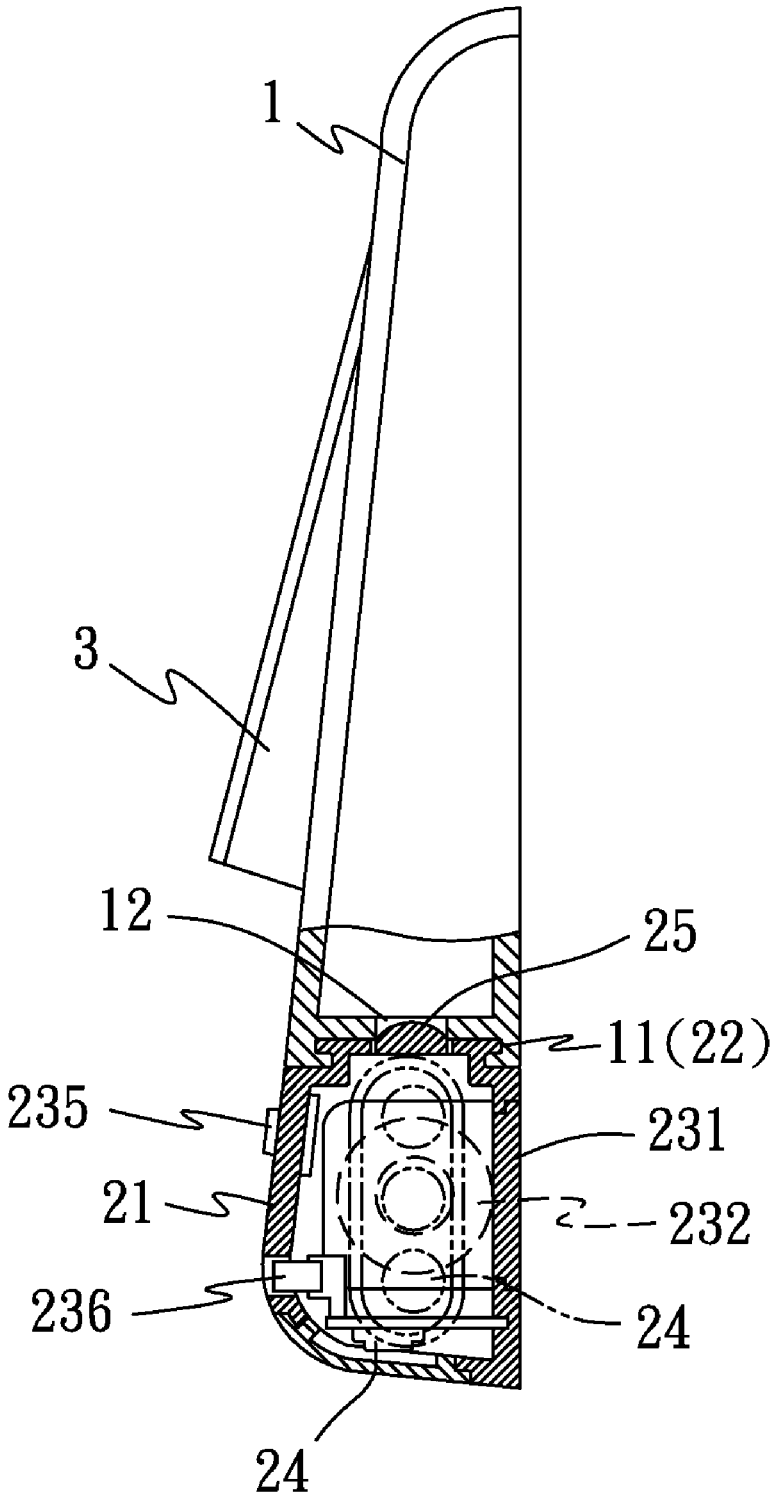
FIG. 3 is a partially sectioned side view of the present invention.
Figure 4:
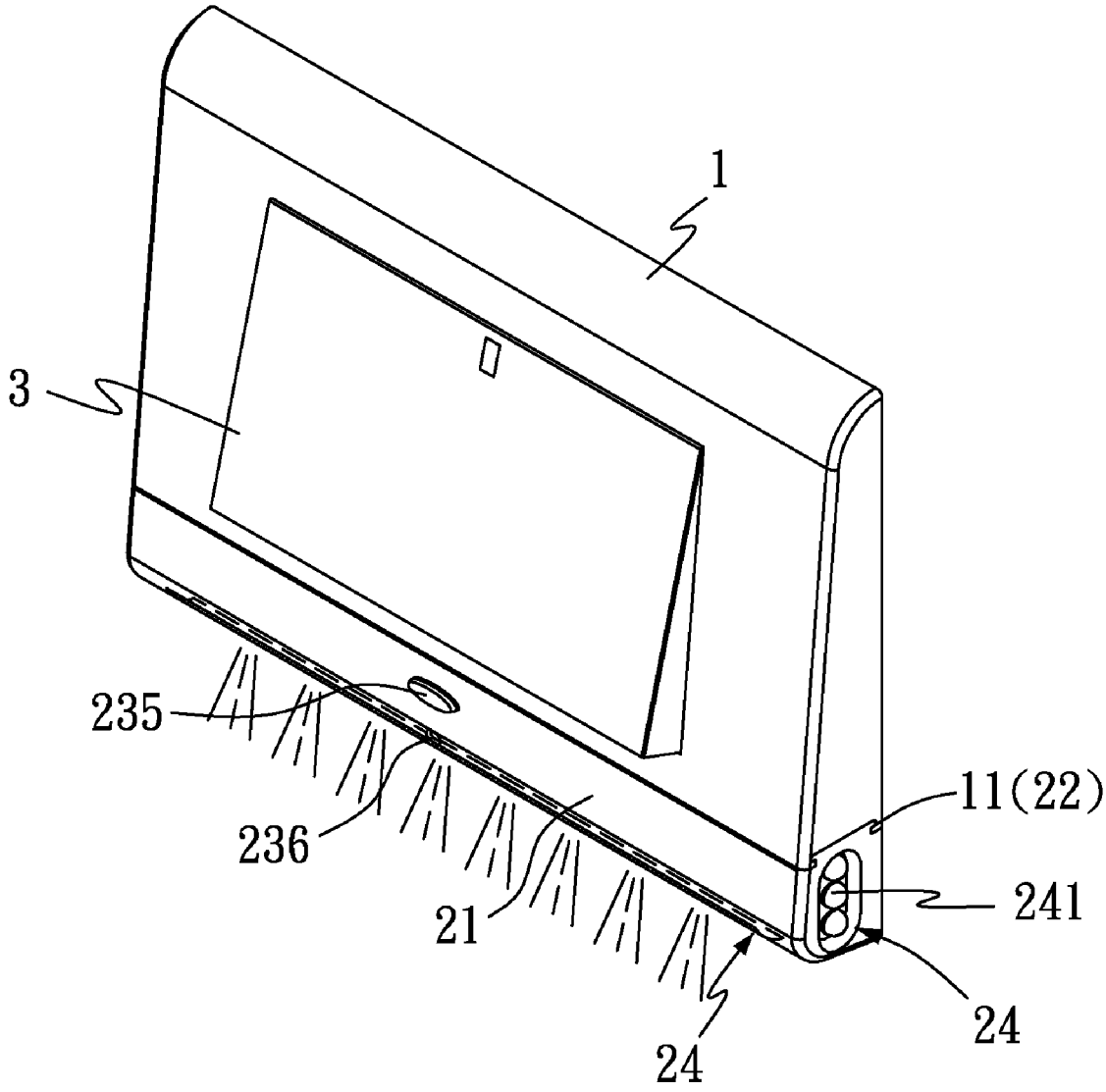
FIG. 4 is a perspective view showing the present invention in use.
Figure 5:
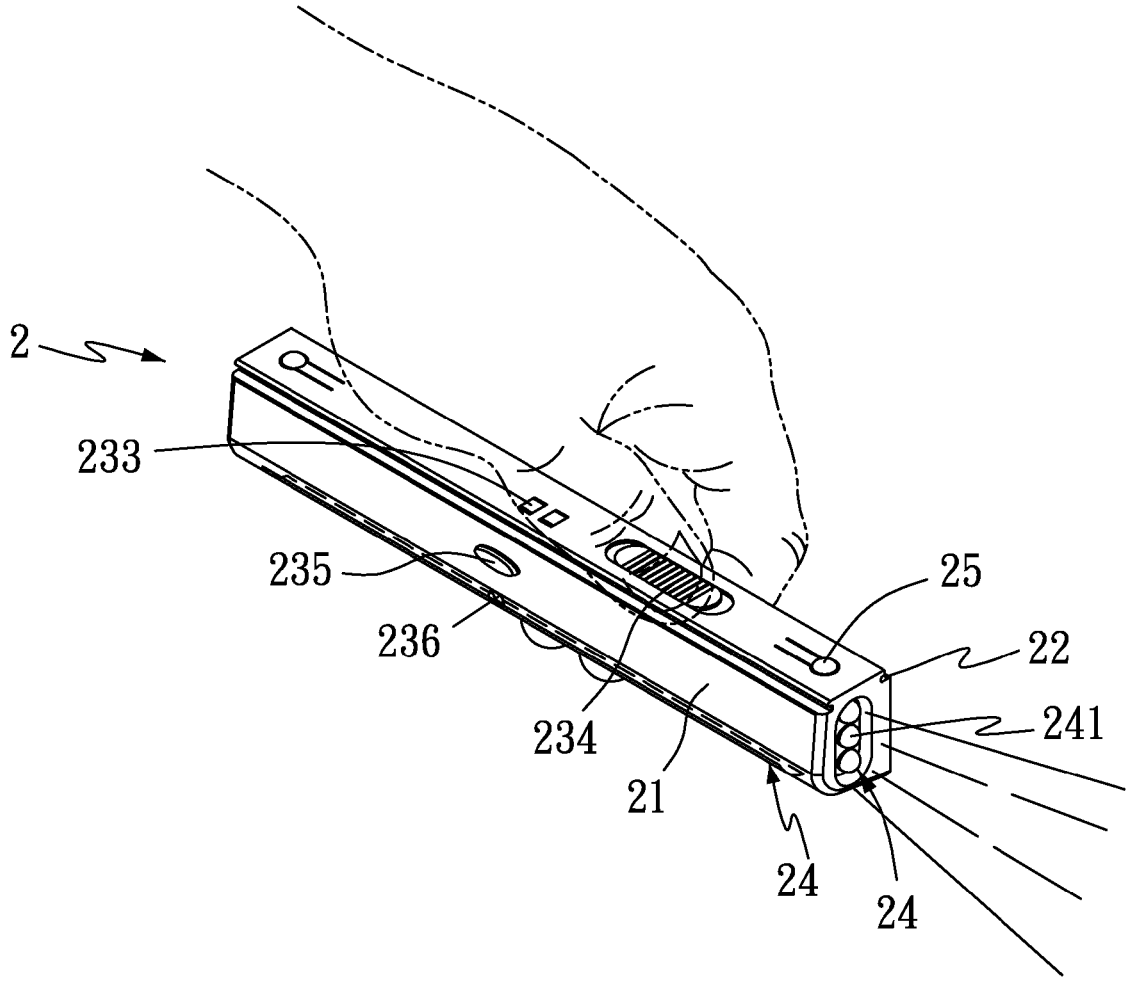
FIG. 5 is a perspective view showing the lighting mechanism of the present invention is separated from the cover plate for use alone as a mobile lighting device.

FIG. 3 is a partially sectioned side view of the present invention, and FIGS. 5 and 6 show two different manners of using the present invention. Please refer to FIG. 1 and FIGS. 3 to 5 at the same time. To use the present invention, the cover plate 1 is mounted to an outer side of a general indoor light switch 3 or an electric socket to replace an original cover plate of the light switch 3. Also, when the cover plate 1 is mounted to the light switch 3, the conductive section 13 of the cover plate 1 is electrically connected to an external power supply to the light switch 3, so that the external power supply may be transmitted to the lighting mechanism 2 via the conductive section 13.

To assemble the lighting mechanism 2 to the cover plate 1, simply slide the retaining section 22 of the enclosure 21 into the receiving section 11 of the cover plate 1, so that the lighting mechanism 2 is associated with the cover plate 1. At the same time, the locating leaf springs 25 interfere with the locating holes 12 to fix the lighting mechanism 2 to the cover plate 1. Under this condition, the power input 233 of the control unit 23 electrically contacts with the conductive section 13 for charging the power supply 232 as well as providing working power for the control unit 23 and the light-emitting unit 24.

After the lighting mechanism 2 has been associated with the cover plate 1, the light-detecting element 236 is able to sense an ambient light source. In the event the ambient light source is sufficient, via the control circuit 231, the light-detecting element 236 shuts off the light-emitting unit 24. On the contrary, in the event the ambient light source is weak or there is not any ambient light source, via the control circuit 231, the light-detecting element 236 cooperates with the power supply 232 to turn on the light-emitting unit 24 for the same to emit light for use as night lighting and emergency lighting. With the above arrangements, the light-emitting unit 24 is turned on/off according to the ambient light source sensed by the light-detecting element 236. However, in the present invention, the control circuit 231 may also be so designed that it is triggered at a power interruption. Thus, in the event the external power supplied to the conductive section 13 is cut off, the control circuit 231 is triggered to directly switch on the power supply 232. At this point, the power supply 232 replaces the external power to immediately supply power to the light-emitting unit 24. Accordingly, the light-emitting unit 24 keeps emitting light to serve as night lighting and emergency lighting.

when the lighting mechanism 2 has been associated with the cover plate 1 over a long time, a user can push the test switch 235, so that the control circuit 231 drives the power supply 232 to supply power to the light-emitting unit 24 for the same to emit light. In this manner, it is able to test whether the control unit 23 and the light-emitting unit 24 function normally or not.

As can be seen from FIG. 5, the lighting mechanism 2 of the present invention can be alternatively used alone as a mobile lighting device. To do so, simply transversely push the lighting mechanism 2 to one side, so that the retaining section 22 of the enclosure 21 is slid off the receiving section 11 to easily release the lighting mechanism 2 from the cover plate 1. Thereafter, a user may hold the lighting mechanism 2 and switch the on/off switch 234 to turn on or off the light-emitting unit 24. When the lighting mechanism 2 is not in use or when it is necessary to recharge the lighting mechanism 2, simply reassemble the lighting mechanism 2 to the cover plate 1 in the aforesaid manner.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A switch cover plate with lighting mechanism, comprising:

a cover plate having a receiving section arranged on at least one edge of the cover plate; a lighting mechanism being removably assembled to the cover plate; the lighting mechanism including an enclosure, a retaining section arranged on at least one side of the enclosure for detachably connecting to the receiving section of the cover plate, a control unit provided in the enclosure, and at least one light-emitting unit provided on the enclosure and electrically connected to the control unit, wherein the receiving section is provided on a wall thereof with a conductive section for electrically connecting to an external power supply.

2. The switch cover plate with lighting mechanism as claimed in claim 1, wherein the receiving section is an insertion channel, and is formed on a wall of the cover plate with a plurality of locating holes.

3. A switch cover plate with lighting mechanism, comprising:

a cover plate having a receiving section arranged on at least one edge of the cover plate;

a lighting mechanism being removably assembled to the cover plate; the lighting mechanism including an enclosure, a retaining section arranged on at least one side of the enclosure for detachably connecting to the receiving section of the cover plate, a control unit provided in the enclosure, and at least one light-emitting unit provided on the enclosure and electrically connected to the control unit; and wherein the retaining section is a guide slide having a plurality of locating leaf springs arranged thereon to interfere with the receiving section.

4. The switch cover plate with lighting mechanism as claimed in claim 3, wherein the receiving section is an insertion channel, and is formed on a front wall of the cover plate with a plurality of locating holes.

* * * * *